United States Patent [19]

Brown et al.

[11] 4,134,678

[45] Jan. 16, 1979

[54] AUTOMATIC BLOOD ANALYSIS APPARATUS AND METHOD

[75] Inventors: Leslie J. Brown, Chestnut Hill; Bruno DeGironimo, Billerica; Charles F. Mountain, Cambridge; Richard B. Stevens, Somerville; Fernando M. Vasconcelos, Lowell, all of Mass.

[73] Assignee: Instrumentation Laboratory Inc., Lexington, Mass.

[21] Appl. No.: 778,045

[22] Filed: Mar. 16, 1977

[51] Int. Cl.[2] ..... G01N 33/16

[52] U.S. Cl. ..... 356/39; 356/40; 422/67; 422/109

[58] Field of Search ..... 356/39–42, 356/188, 201, 204–206, 36, 73; 23/90, 214

[56] References Cited

U.S. PATENT DOCUMENTS

| | | | |
|---|---|---|---|
| 3,472,594 | 10/1969 | Hughes et al. | 356/205 |
| 3,634,039 | 1/1972 | Brondy | 356/39 |
| 3,690,833 | 9/1972 | Ferrari | 356/39 |
| 3,764,268 | 10/1973 | Kosowsky et al. | 23/253 R |
| 3,775,595 | 11/1973 | Rosse et al. | 23/230 B |
| 3,874,850 | 4/1975 | Sorensen et al. | 23/230 B |
| 3,972,614 | 8/1976 | Johansen et al. | 356/36 |

*Primary Examiner*—John K. Corbin
*Assistant Examiner*—Wm. H. Punter
*Attorney, Agent, or Firm*—G. Eugene Dacey

[57] ABSTRACT

Method and apparatus for the simultaneous automatic analysis and sequential displaying in digital form of a plurality of parameters of whole or hemolyzed blood samples, such as total hemoglobin, percent oxyhemoglobin, percent carboxyhemoglobin, percent methemoglobin (in each case percent meaning percentage of total hemoglobin) and oxygen content. The apparatus is an electro-optical instrument including a servo-controlled spectral line source, such as a hollow cathode lamp, a laser etc., a ratiometric logarithmic amplifier of minimized dynamic range, a fluid-flow system of improved design that combine to measure the absorbances of blood samples at a plurality of wavelengths defined and generated by the spectral line source, to calculate the above parameters based on the absorbances by the use of a micro-computer and associated circuitry absorbances, to display automatically and digitally one of the parameters, and then to display digitally seriatim the remaining parameters responsive to operator intervention.

18 Claims, 8 Drawing Figures

AUTOMATIC BLOOD ANALYSIS APPARATUS AND METHOD

BACKGROUND OF THE INVENTION

1. Field of the Invention

The present invention relates to an automatic blood analysis apparatus and method for the simultaneous automatic analysis for a plurality of parameters of whole blood. Analyses of that type include determination of parameters such as total hemoglobin, oxygen content and three known percentages based on total hemoglobin.

2. Description of the Prior Art

There are many known apparatus related to and used in the photometric determinations for constituents of blood samples. Each one of these prior art apparatus, however, suffers from at least one built-in limitation, namely, that in employing a conventional light source with filters, the same encounters drift which affects the wavelength transmitted through the specimen after a period of time of use. Consequently, readings of the instruments become progressively less reliable with the passing of time.

The photometer disclosed in U.S. Pat. No. 3,694,092 is designed to analyze for albumin and bilirubin in serum through a combination of a conventional light source and a rotating filter wheel. It transmits through the sample two wavelengths and then by multiplying the test result of the sample for one wavelength by a certain coefficient and subtracting the value obtained from the test result of the sample for the other wavelength, quantitatively analyzes the sample. An apparent improvement of this is the disclosure in U.S. Pat. No. 3,902,812 which employs three kinds of light wavelengths again obtained from a conventional light source by means of a three-segment filter wheel and in which the three wavelengths are used to eliminate the influence of two components except the one to be measured.

The closest known disclosure appears to be U.S. Pat. No. 3,972,614 to Johansen et al which again uses a conventional light source and by means of a rotating filter wheel employs two wavelengths and then transmits these wavelengths through a hemolyzed blood sample, with hemolyzing effected by ultrasonic means and without the use of a diluent. The patent teaches the measurements for the concentrations of only two constituents, namely, oxyhemoglobin and reduced hemoglobin at these two wavelengths to arrive at total hemoglobin. Consequently, the measurements do not take into account the presence of methemoglobin and carboxyhemoglobin and when either of these concentrations are present in the sample it requires that corrections be made to the results obtained by the instrument.

Other disclosures known include that of U.S. Pat. No. 3,748,044 which again uses a conventional light source and filters. It employs a cycling apparatus to cause the beam sequentially and separately to pass through each of a multiplicity of specimens during the multiple cycles of operation. It then determines the rate at which reactions take place in each of the specimens by comparing the second set of values to the first set of values previously stored in memory. The U.S. Pat. No. 3,807,877 discloses a photometer again employing a conventional light source in which the light transmitted by a reference and a sample substance is alternately measured to have an output voltage representative of the sample density, with the photometer sensitivity varied as a function of this output voltage, by scaling the output of the detector to the input power. U.S. Pat. No. 3,437,822 discloses a radiation absorption measuring device again employing a conventional light source in which the lamp supply is controlled by a feedback amplifier so as to stabilize the light source output power. U.S. Pat. No. 3,690,772 shows an apparatus again using a conventional light source by which light pulses are transmitted through at least three light ray paths at intermittent intervals so that no more than one light path is illuminated during any instant of time. The pulses of one path are used as a reference pulse and the remaining pulses filtered, aligned, and passed through the sample. Light passing through the sample and also light on the referenced paths are then directed to a single photo cell. Output signals from the photo cell are maintained steady to prevent light source intensity variations from influencing readings.

Each of these prior art devices suffers from not providing that high degree of precision of repeated readings that today's clinical market requires for the automatic measurements of parameters contained in whole blood.

SUMMARY

The object of the present invention is to provide an apparatus and a method for the simultaneous automatic analysis of whole blood which gives repeated readings of extreme precision and which is not affected adversely by drift over extended periods of use. Essentially this is so since rather than employing a conventional light source, it employs a means for generating spectral lines of high resolution which means may be a hollow cathode lamp, a laser or the like whose selected wavelengths output will not change despite extended use. Thus, the instrument is free from the problems heretofore encountered using conventional light sources with optical filters. A further problem has also been eliminated. It is known that optical interference filters tend to degrade over periods of time. When using a conventional light source, the problem is compounded in that the degradation in the filter affects both the wavelength and the intensity of light transmitted thereby. In the instrument of the invention, however, any filter degradation only affects the intensity of the light transmitted thereby since the precise wavelength is defined and determined by the source itself which in the preferred embodiment comprises a hollow cathode lamp in which the cathode is made of thallium and neon.

Essentially, the apparatus is an electro-optical instrument which employs a servo-controlled source of spectral lines so as to maintain the light intensity output of each spectral line emanating from the source constant, and a ratiometric logarithmic amplifier of minimized dynamic range, the combination of which gives greatly improved stability and accuracy. Combining with this electro-optical instrument for the measurement of such parameters of blood as total hemoglobin, oxygen content and the derivative percentages of total hemoglobin is a fluid-flow system of improved design which includes a multi-segment peristaltic pump having a plurality of pump-cages for selective rotation by means of uni-directional clutches and a motor and in which the pump-cages and tubings wound around them also act as pinch-valves precisely to arrest fluid pumped through the tubes wound about the pump-cages. This allows for controlled mixing of sample with a diluent and also for automatic flushing of the fluid-flow system following each measurement.

The analytical basis for the apparatus has been developed mathematically from Beer's law of absorption spectroscopy which defines the photometric relationships used in measuring the concentration of a colored compound. That is, at a given wavelength and at a fixed pathlength (l), the light transmitted (I) through a colored solution decreases logarithmically with increasing concentration (C). This can be written in terms of the absorbance (A) as:

$$\log_{10}\left(\frac{I_o}{I}\right) = \epsilon l C = A \qquad \text{Equation 1}$$

where $I_o$ is the incident light and $\epsilon$ is the molar absorption coefficient.

Rewriting Equation 1 and solving for concentration (C):

$$C = \frac{A}{\epsilon l} = \frac{1}{\epsilon l}\log_{10}\left(\frac{I_o}{I}\right) = \frac{(\epsilon)^{-1}}{l}\log_{10}\left(\frac{I_o}{I}\right) \qquad \text{Equation 2}$$

where $1/\epsilon = (\epsilon)^{-1}$ is the inverse of the molar absorption coefficient ($\epsilon$).

Using a hollow cathode lamp whose cathode is composed of a thallium and silver amalgam, with a neon gas fill, four highly distinct, narrow bandwidth spectral lines have been selected at the following wavelengths: 535.0 nm from thallium, and 585.2, 594.5 and 626.6 nm from neon. Then at each of these four wavelengths, four molar extinction coefficients were determined for each of the four hemoglobin species [reduced hemoglobin (RHb), oxyhemoglobin ($O_2Hb$), carboxyhemoglobin (COHb), and methemoglobin (MetHb)]. $\epsilon$ is then written in a matrix form as:

$$\epsilon = \begin{pmatrix} \epsilon_{535.0,\,RHb} & \epsilon_{585.2,\,RHb} & \epsilon_{594.5,\,RHb} & \epsilon_{626.6,\,RHb} \\ \epsilon_{535.0,\,O_2Hb} & \epsilon_{585.2,\,O_2Hb} & \epsilon_{594.5,\,O_2Hb} & \epsilon_{626.6,\,O_2Hb} \\ \epsilon_{535.0,\,COHb} & \epsilon_{585.2,\,COHb} & \epsilon_{594.5,\,COHb} & \epsilon_{626.6,\,COHb} \\ \epsilon_{535.0,\,MetHb} & \epsilon_{585.2,\,MetHb} & \epsilon_{594.5,\,MetHb} & \epsilon_{626.6,\,MetHb} \end{pmatrix} \qquad \text{Equation 3}$$

In the present apparatus, the light intensities $I_o$ and I are normalized values which are obtained as follows. The light is split into two beams by a beam splitter with approximately 90% of the light continuing toward the sample photodiode and 10% of the light being reflected toward a reference photodiode. The currents produced by the sample photodiode ($I_s$) and reference photodiode ($I_R$) are then fed into a ratiometer logarithmic amplifier which generates an output voltage (V):

$$V = K\log_{10}\left(\frac{I_R}{I_s}\right) \qquad \text{Equation 4}$$

where K is a scalar multiplier.

With an optically clear solution (zeroing solution) in the cuvette, $V_{blank}$ ($V_b$) is generated by the ratiometer logarithmic amplifier. With a hemoglobin solution in the cuvette, $V_{sample}$ ($V_s$) is generated. The absorbance of the hemoglobin solution is then $$A = \frac{V_s - V_b}{K} \qquad \text{Equation 5}$$

Equation 2 is now expanded to solve for the concentrations (C) of the four hemoglobin species, using $\epsilon$ from Equation 3 and A from Equation 5, at each wavelength.

$$C_{RHb} = \frac{1}{l}\left[A_{535.0}(\epsilon_{535.0,\,RHb})^{-1} + A_{585.2}(\epsilon_{585.2,\,RHb})^{-1} + A_{594.5}(\epsilon_{594.5,\,RHb})^{-1} + A_{626.6}(\epsilon_{626.6,\,RHb})^{-1}\right] \qquad \text{Eqn. 6a}$$

$$C_{O_2Hb} = \frac{1}{l}\left[A_{535.0}(\epsilon_{535.0,\,O_2Hb})^{-1} + A_{585.2}(\epsilon_{585.2,\,O_2Hb})^{-1} + A_{594.5}(\epsilon_{594.5,\,O_2Hb})^{-1} + A_{626.6}(\epsilon_{626.6,\,O_2Hb})^{-1}\right] \qquad \text{Eqn. 6b}$$

$$C_{COHb} = \frac{1}{l}\left[A_{535.0}(\epsilon_{535.0,\,COHb})^{-1} + A_{585.2}(\epsilon_{585.2,\,COHb})^{-1} + A_{594.5}(\epsilon_{594.5,\,COHb})^{-1} + A_{626.6}(\epsilon_{626.6,\,COHb})^{-1}\right] \qquad \text{Eqn. 6c}$$

$$C_{MetHb} = \frac{1}{l}\left[A_{535.0}(\epsilon_{535.0,\,MetHb})^{-1} + A_{585.2}(\epsilon_{585.2,\,MetHb})^{-1} + A_{594.5}(\epsilon_{594.5,\,MetHb})^{-1} + A_{626.6}(\epsilon_{626.6,\,MetHb})^{-1}\right] \qquad \text{Eqn. 6d}$$

The total hemoglobin (THb) is then defined as the sum of the four concentrations from Equations 6a, 6b, 6c, and 6d:

$$\text{THb} = C_{RHb} + C_{O_2Hb} + C_{COHb} + C_{MetHb} \text{ and} \qquad \text{Eqn. 7}$$

$$\%O_2\text{Hb} = \frac{C_{O_2Hb} \times 100}{\text{THb}} \qquad \text{Eqn. 8a}$$

$$\%\text{COHb} = \frac{C_{COHb} \times 100}{\text{THb}}, \text{ and} \qquad \text{Equation 8b}$$

$$\%\text{MetHb} = \frac{C_{MetHb} \times 100}{\text{THb}} \qquad \text{Equation 8c}$$

The oxygen content is calculated using $^{C}O_2Hb$ from Equation 6b:

$$O_2 \text{ content} = 1.39 \times C_{O_2Hb} \text{ Vol. \% } O_2 \qquad \text{Equation 9}$$

BRIEF DESCRIPTION OF THE DRAWINGS

These and other advantages and features of the present invention will hereinafter appear for the purposes of illustration, but not of limitation, in connection with the accompanying drawings, in which like numbers refer to like parts throughout and in which.

DESCRIPTION OF THE PREFERRED EMBODIMENT

Figure 1:
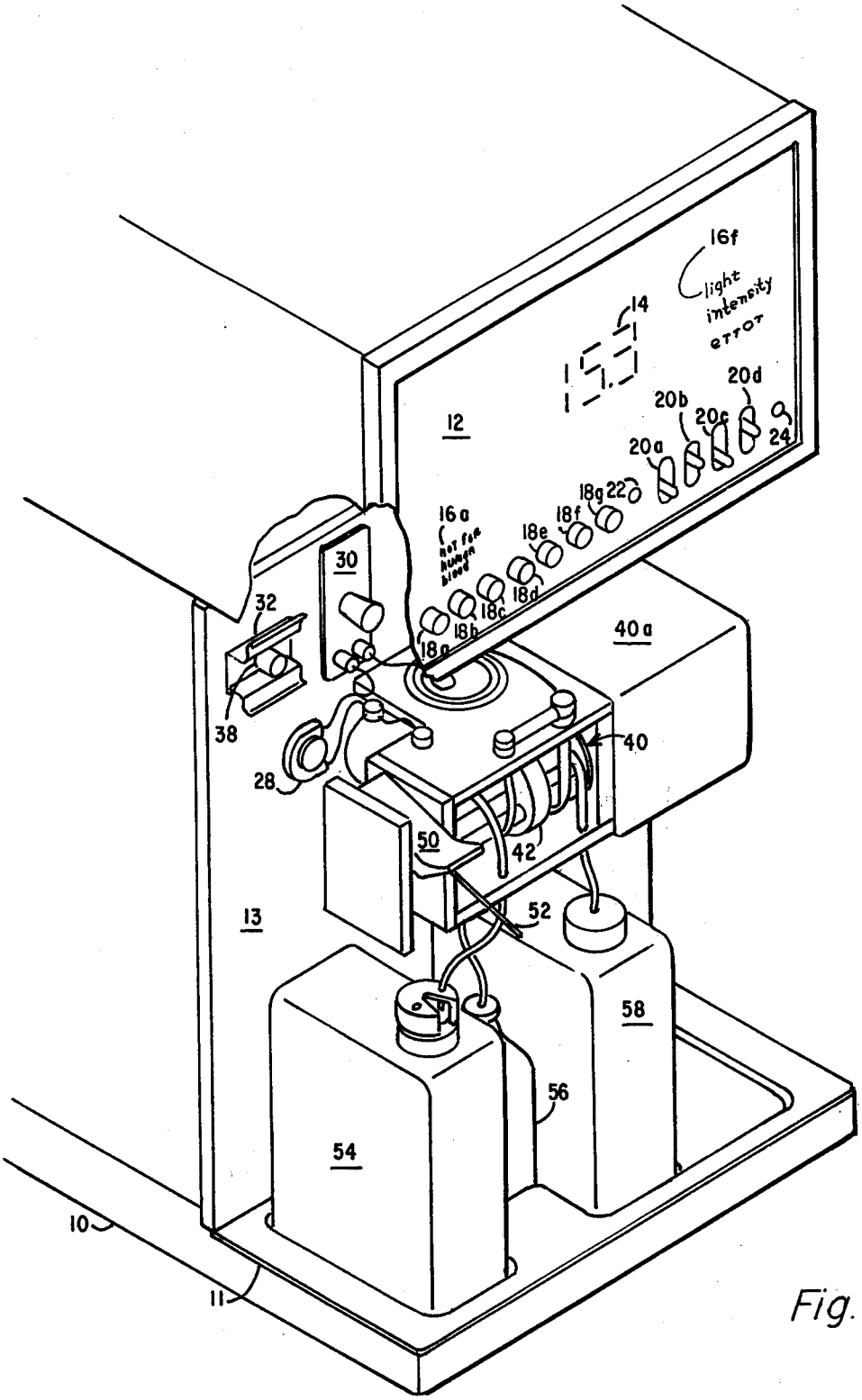
FIG. 1 is a perspective view of a preferred form of automatic blood analysis apparatus made in accordance with and embodying the present invention.
Figure 2:
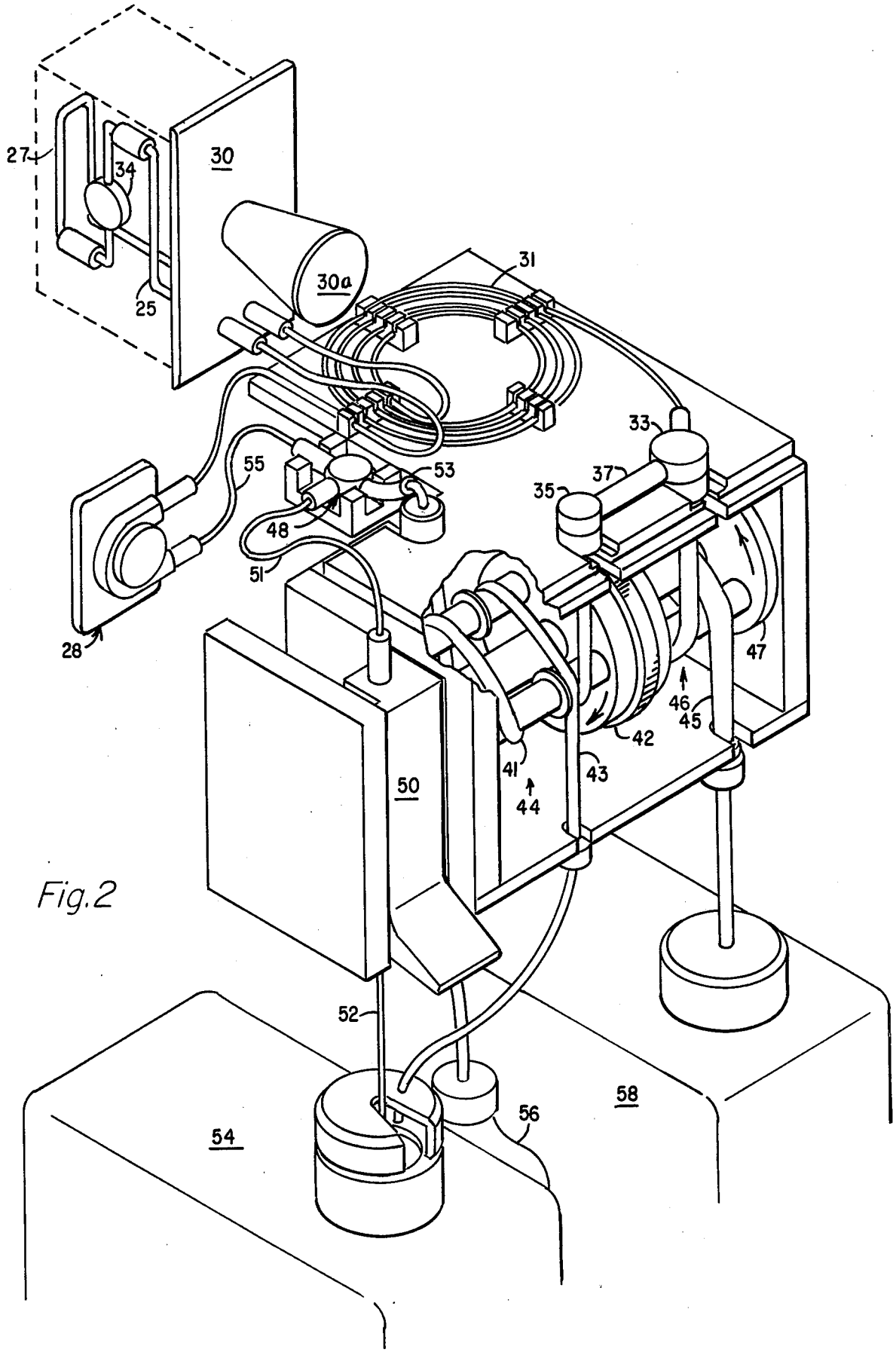
FIG. 2 is a perspective view of a portion of the apparatus shown in FIG. 1 but on an enlarged scale and showing particularly the fluid-flow system thereof.

Referring to the drawings and in particular to FIGS. 1 and 2, a preferred form of an automatic blood analysis apparatus 10 made in accordance with the present invention is shown in a front perspective view, with FIG. 2 being on an enlarged scale and with parts of the apparatus broken away, showing particularly the fluid-flow system thereof.

The operating controls for the apparatus are mounted on a display panel 12 on which the measured parameters are digitally displayed by a four digit LED display 14. There are a series of seven (7) push-button switches 18*a*, 18*b*, 18*c*, 18*d*, 18*e*, 18*f*, and 18*g* conveniently mounted in the lower left portion of the display panel, followed further to the right by a series of four (4) toggle switches 20*a*, 20*b*, 20*c*, and 20*d*. Between the toggle switches 20*a* through *d* and the push-buttons 18*a* through 18*g* is disposed the only user-adjustable calibration screw 22 for total hemoglobin which may be adjusted by means of a small screwdriver. To the right of the toggle switches 20*a* through *d* is located a stop button 24. The respective functions and operation of these push buttons, toggle switches, total hemoglobin calibration adjustment and stop button will be more fully described below in conjunctionwith the detailed description of the operation of the apparatus and in particular with reference to FIG. 8 which represents the flow chart of system operation.

In the space just above the push buttons and toggle switches and below the LED display 14 there are a series of six (6) warning lights 16*a* through 16*f* which when illuminated are designed to warn the operator of certain conditions in the operation of the apparatus. The first warning light 16*a* displays the words "not for human blood" and which when lit tells the operator that the apparatus in that mode is set to operate with animal blood only. Consequently, human blood samples must not be run when this warning light 16*a* appears on the display panel. The other five warning lights are "check cuvette" 16*b*, "high MetHb question data" 16*c*, "absorbance error" 16*d*, "temp. unregulated" 16*e*, and "light intensity error" 16*f*. These also will be more fully described when describing the operation of the apparatus.

The apparatus, which may be bench mounted, is provided with a vacuum formed removable tray 11 which accommodates three bottles in an upstanding position needed in the operation of the apparatus, namely a waste bottle 54, a zeroing/flush solution bottle 58, which are of like volume and a smaller diluent containing bottle 56 positioned in between. In the space above the bottles and below the display panel 12 and secured to front plate 13 is mounted the fluid-flow system which essentially comprises a multi-segment peristaltic pump 40 driven by a reversible motor 40*a*. To the left of the pump is located a standard sampler 50 provided with a sampler probe 52 shown in its sampling position in FIG. 1 and in the flush position in FIG. 2. It should be noted that the apparatus may also be conveniently provided with an alternative sampling system for use for the syringe injection of samples, not shown, and also with a capillary sampler which may comprise the standard sampler 50 but with the addition of an accessory adapter, not shown.

The reversible bidirectional electric motor 40*a* is designed to rotate in either direction a drive shaft about which pump-cages 44 and 46 are mounted consisting of three rods disposed at an angle of about 120° one from the other and being concentric about the drive shaft. The pump-cages 44 disposed on the left-hand side have the diluent tube winding 41 and the sample tube winding 43 wound about them while the pump-cage 46 on the right-hand side has the flush tube winding 45 wound about it. The pump-cages 44 and 46 are separated by a cylindrical member 42 which is also concentrically mounted about the motor's drive shaft and for concurrent continuous rotation with the shaft. This cylindrical member 42 is serrated about its periphery and is preferably provided with drive clutches about its sides so as to allow for manual operation of the apparatus by turning this member 42 in the respective directions, as may be required. Each of the flexible tube windings is respectively connected to its bottle as shown. The sampler probe is connected by a tube 51 to a sample and diluent mixing "T" 48 to which is also connected a tubing 53 connecting with the diluent tube winding 41 about the pump-cage 44. From the mixing "T" 48, a further flexible tube 55 is connected to a mechanical hemolyzer 28 which may be a solenoid and hence into a cuvette 34 disposed in a cuvette holder assembly 30 which is designed to be removable for easy inspection, cuvette replacement or clot as by a handle 30*a*. Within the cuvette assembly 30, the tubes preferably comprise a blood preheater portion 25 preceding the cuvette 34 and a flush solution preheater portion 27 following the cuvette 34. The tube emerging from the cuvette holder 30 is then wound in a coil 31, as shown, before being connected to a second "T" adapter 33 which has a connection on the one hand to the flush tube winding 45 wound about the pump-cage 46 and via a short connecting tube 37 and an adapter 35 to the sample tube winding 43 wound about the pump-cage 44.

For the proper operation of the fluid-flow system, there are also provided one-way clutches 47 disposed at the respective ends of the pump-cages 44 and 46 away from the centrally disposed cylindrical member 42. These one-way clutches 47 operate to insure that the flush side pump-cage 46 rotates with the rotating drive shaft in only the direction shown by the arrow in FIG. 2 while at the same time the aspirating pump-cages 44 remain at a standstill and, with the motor and drive shaft driven in a reversed direction, the pump-cages 44 on the aspirating side are rotated in the direction of the shown arrow and at the same time the flush pump-cage 46 remains at a standstill. It should be particularly noted that these pump-cages, composed as they are of three horizontal bars disposed at 120° angles to each other, also function as pinch-valves for the flexible tubes wound about these pump-cages and as such pinch-valves, they serve precisely to arrest fluid-flow through the system so as to effectuate and control the fluid transfer of small and precise amounts.

Near the cuvette holder 30 removably disposed in the front plate 13 is mounted a cuvette clip 32 having a centrally disposed light 38 that conveniently serves two functions. This light 38 is always on when the power is on in the apparatus and indicates that condition to the operator. In addition, it serves as the light against which to check the cuvette 34 when the same is removed from its normal position shown and disposed within the cuvette clip 32 so as to allow the operator to see whether or not there may be a blood clot, impurity or other foreign substance in the cuvette, especially when one of the previously mentioned warning lights is illuminated on the display panel.

Figure 4:
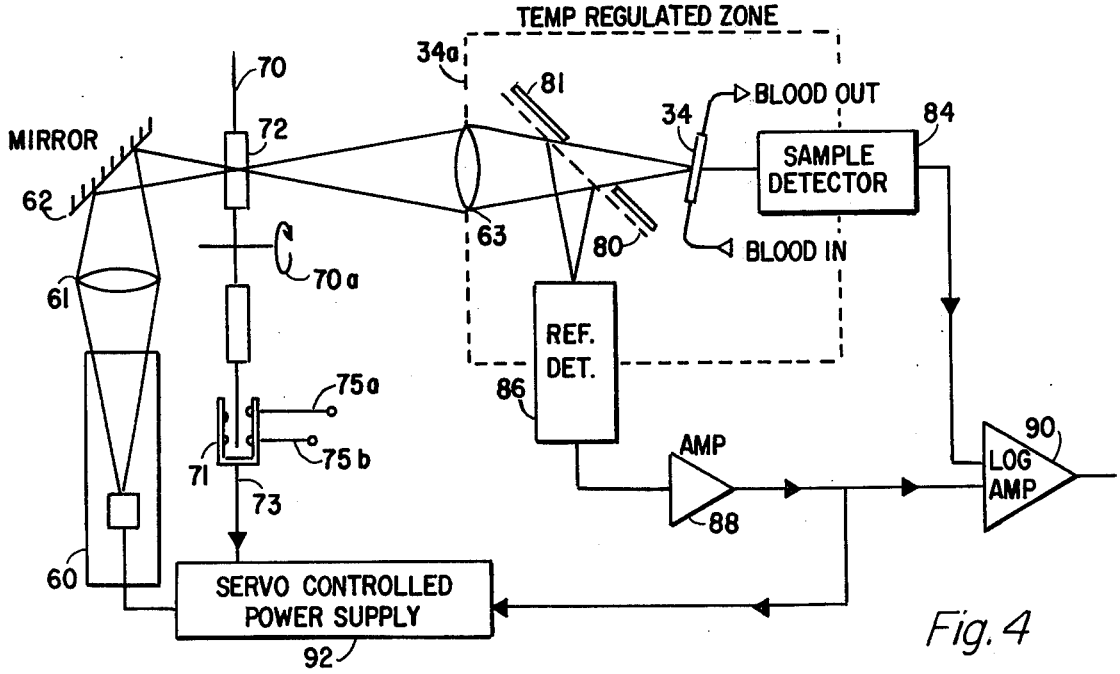
FIG. 4 is a block diagram of the electro-optical system employed in the apparatus and showing particularly the servo-controlled power supply for the hollow cathode lamp and the logarithmic amplifier.
Figure 5:
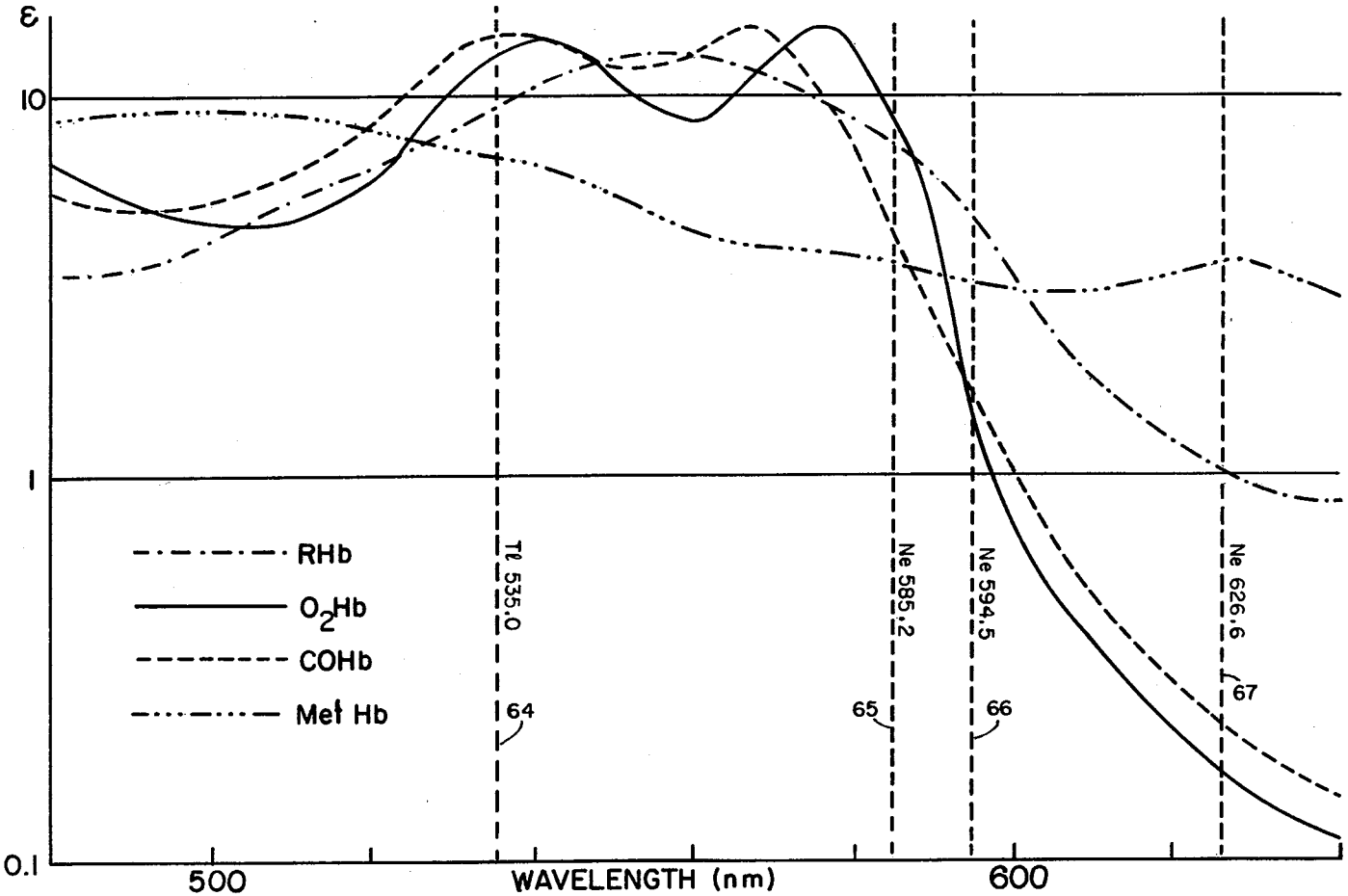
FIG. 5 is a chart plotting the extinction coefficients ($\epsilon$) for the four human blood parameters, namely reduced hemoglobin, oxyhemoglobin, carboxyhemoglobin and methemoglobin plotted as a function of wavelength in nanometers (nm) and also showing the four selected wavelengths employed in the instrument and as defined and generated by the spectral line source, namely a hollow cathode lamp employed in the apparatus.

The electro-optical system of the apparatus is best described with reference to FIGS. 3 and 4. One of the more important parts of this system is the source of spectral lines which generate and define the four selected wavelengths employed in the apparatus of the invention. The wavelengths defined by this source 60 remain stable and drift-free even after an extensive time period of use of the instrument and hence are instrumental for providing, in combination with the other parts of the apparatus, reliable and accurate readings with a high degree of repeatability. This source 60 of spectral lines may comprise a suitable laser or other spectral line source, but, due to practical economic considerations, in the preferred embodiment a hollow cathode lamp 60 is employed to generate and define these four selected wavelengths in the visible spectrum. Furthermore, we have selected a hollow cathode lamp 60 whose cathode is made up of thallium and neon to generate and define the wavelengths of high resolution of interest, namely 535.0 nm for thallium, and 585.2 nm, 594.5 nm and 626.6 nm for neon, as shown in FIG. 5.

These respective spectral lines emanating from the hollow cathode lamp 60 are then focused by a suitable lens 61 and reflected by a mirror 62 through one of a number of narrow band-width filters 72 arranged about a filter wheel 70 rotated by a suitable electric motor **70*a* in the direction of the indicated arrow. The function of these narrow band-width filters 72 is simply to prevent the transmission therethrough of other spectral lines, except the respective one of the four above mentioned. These filters, like all filters, do tend to undergo a change with time. Nevertheless, in the combination of this apparatus with its particular source, a change in the characteristics of these narrow band-width filters 72** does not effect a change or drift in the particular wavelength transmitted therethrough but rather it affects only the intensity of the transmitted light. Hence, the readings remain accurate and reliable even over extensive use of the apparatus of the invention because absorbance measurements, which normally vary with wavelength, do not vary in the embodied invention because the wavelengths of the selected source do not vary.

The particular selected wavelength passing through its respective narrow band-width filter 72 is then refocused by another lens 63 and hence passed through a beam splitter 80 whose back side is covered by a suitable mask 81. By means of this beam splitter 80, approximately 10% of the light is split so as to be directed at a reference detector light sensing means 86. The remaining about 90% of the light is admitted through the beam splitter 80 and hence through the cuvette 24, which may either contain a zeroing solution or a hemolyzed sample of blood, and then is permitted to strike a sample detector light sensing means 84. It should be noted that the cuvette is positioned at a slight angle to the light passing through lens 63 rather than being normal thereto. This is so to cause any reflections from the surface of the cuvette to be directed onto the mask 81 rather than being reflected back through the beam splitter 80 and eventually to the reference detector light sensing means 86, a condition that would adversely affect the readings of the reference detector.

It should also be noted that the cuvette 34 and portions of the flexible tubes attached thereto, the beam splitter 80 with its mask 81, the lens 63 and at least portions of the sample and reference light sensing means 84 and 86 are disposed within a temperature regulated zone 34a so as to maintain the hemolyzed sample within the cuvette 34 always at a constant temperature, which has been selected to be 37.0° C. The logarithmic amplifier 90 is also preferably in close proximity to the temperature regulated zone to further improve its stability.

The output of the reference detector light sensing means 86 is first coupled to a transresistance amplifier 88 whose output is connected in parallel both to a logarithmic amplifier 90 as well as to a servo-controlled power supply 92 for the hollow cathode lamp. The other output to the logarithmic amplifier 90 is derived from the output of the sample detector light sensing means 84. The detailed functioning of this logarithmic amplifier 90 and of the servo-controlled power supply 92 so as to control and adjust the light intensity output of the hollow cathode lamp 60 will be more fully described with reference to FIG. 7.

Figure 3:
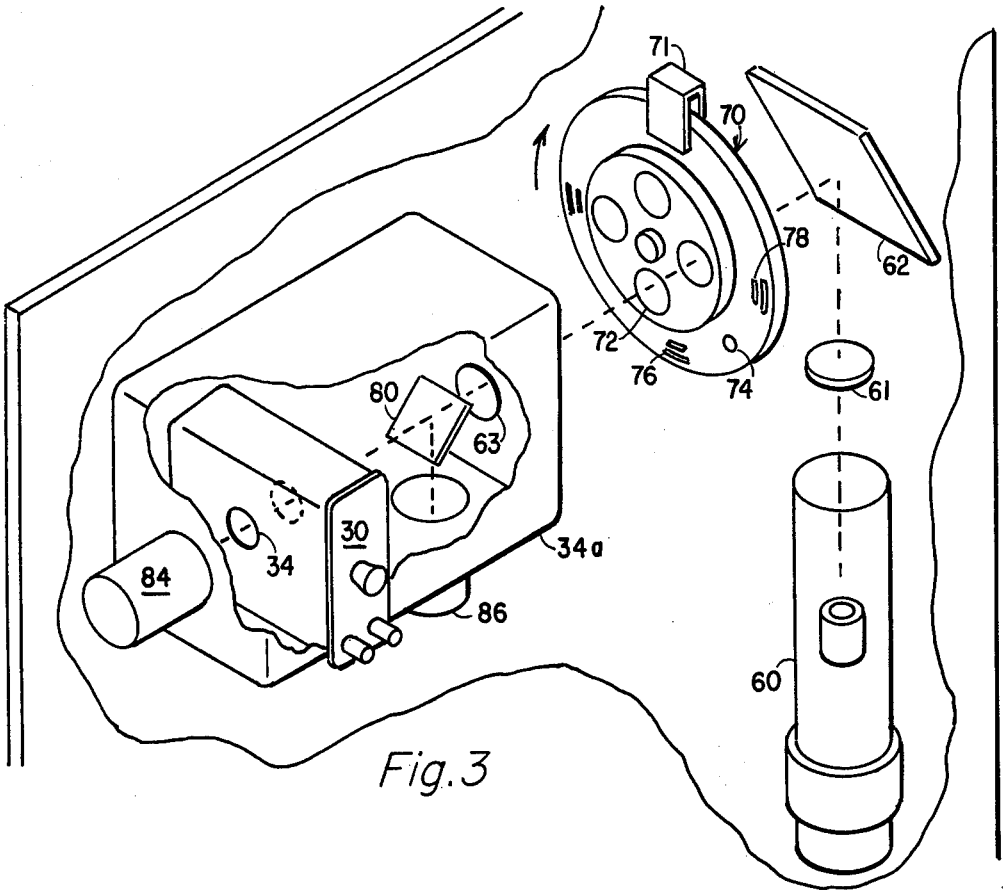
FIG. 3 is a view in perspective of the electro-optical parts of the apparatus of FIG. 1 with parts broken away.

As may be particularly noted in FIG. 3, the filter wheel 70 is provided with a series of radial slots 76 and 78 and at least one hole 74 in its periphery, with the slots arranged adjacent the four narrow band-width filters 72 mounted on the wheel. The hole 74 represents a synchronizing notch which commences the input cycle for the system, as will be more fully described below. There are a series of two radial slots 76 and 78 positioned with respect to each one of the four narrow band-width filters 72. The outer slot 76 which is somewhat longer than the inner slot 78, serves as the servo slot to admit therethrough a servo pulse of somewhat longer duration than the sample pulse determined by sample slot 78. The filter wheel 70 and these slots and the synchronizing notch 74, which is at the same radial distance as the inner sample slots 78, are rotated through a stationary filter position detector circuit 71. This detector circuit 71 consists of two identical circuits disposed one on each side of the rotating filter wheel 70. Each of these identical circuits comprises an infrared light emitting diode (LED) facing a phototransistor and with the filter wheel 70 running between the respective light emitting diode and phototransistor. These circuits detect the synchronizing signal when the synchronizing notch 74 sweeps by the LED and also detect and generate servo pulses and somewhat shorter sample pulses for the time duration that the respective sample 78 and servo slots 76 pass by their respective LEDs in the filter position detector circuit 71. The servo pulses generated are conducted by a servo pulse line 73 to the servo-controlled power supply 92 so as to be employed in the operation of the hollow cathode lamp 60, as will be more fully described below, while the synchronizing pulses and sample pulses are coupled by means of synchronizing and sample pulse lines 75a through 75b to the analog to digital converter, as more fully described below.

Figure 7:
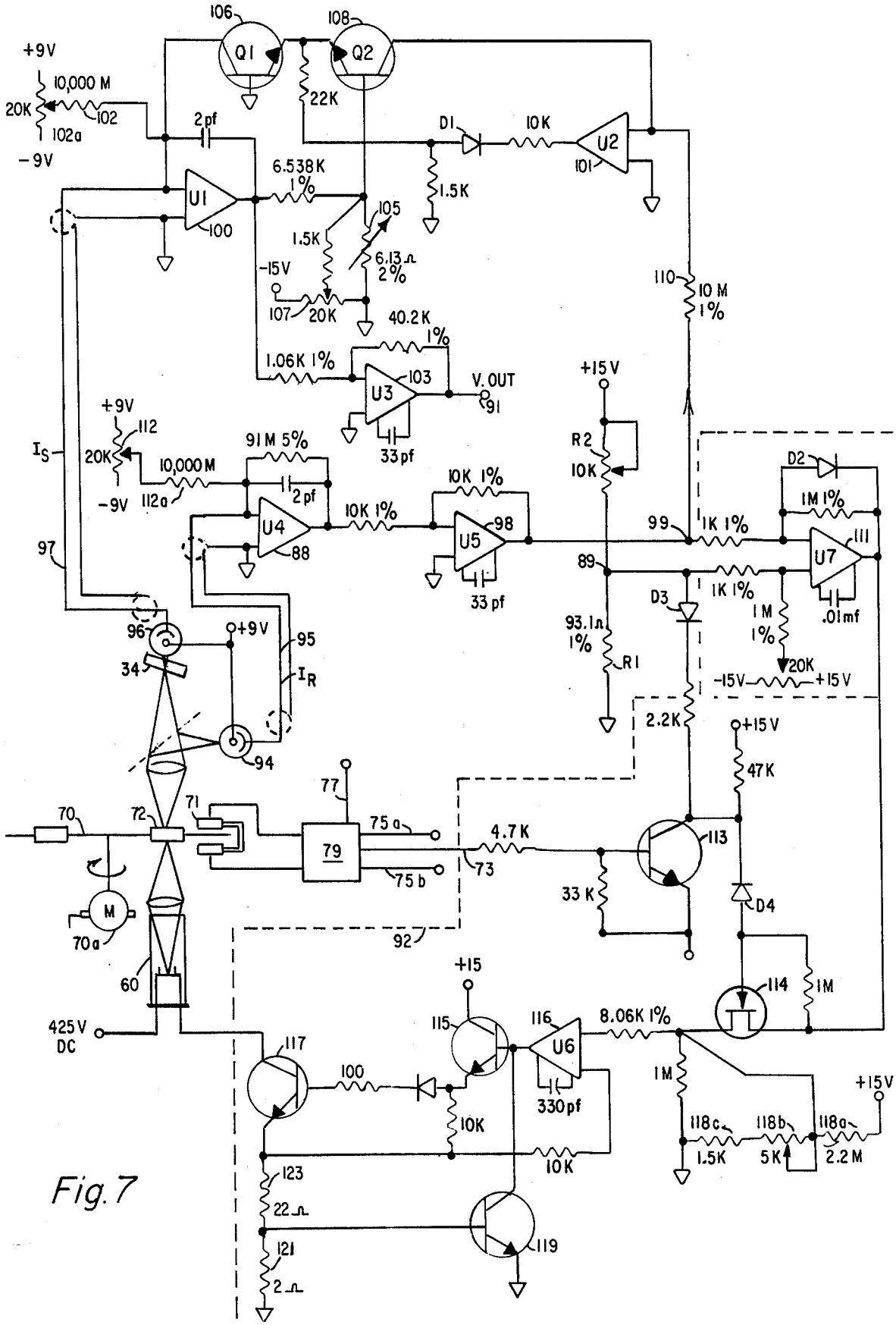
FIG. 7 is a detailed circuit diagram of the ratiometric logarithmic amplifier and servo-control system for the hollow cathode lamp employed in the apparatus.

The detailed circuit diagram of the ratiometric logarithmic amplifier and of the servo-controlled power supply system for the hollow cathode lamp is disclosed in FIG. 7 of the drawings. The purposes of the ratiometric logarithmic amplifier is to produce an output voltage at its output 91 ($V_{out}$) which is proportional to the logarithm of the ratio of two currents, namely a reference current $I_R$ and a sample current $I_S$. These reference and sample currents are generated in response to a beam of light (as defined and generated by said hollow cathode lamp 60 and transmitted through the electro-optics of the system, as above described) beam split so as approximately 10% thereof striking reference photodiode 94 and the remaining approximately 90% of the beam, after passing through the cuvette 34, striking the sample photodiode 96. Co-axial cables 95 and 97 respectively connect the photodiodes to their circuitry.

The reference current $I_R$ is transmitted by co-axial cable 95 to a transresistance amplifier 88 which converts it into a voltage output which voltage is then inverted and amplified by buffer amplifier 98 so as to supply a voltage drop across the reference current resistor 110 coupled to amplifier 98 output at point 99. This voltage at point 99 is also sensed at the negative input of amplifier 111 and compared thereby to a reference voltage established at point 89 which represents the junction of a resistance network composed of two resistances $R_1$ and $R_2$, one $R_1$ of which is grounded, and the other $R_2$ is connected to a positive 15 volt DC voltage.

If the voltage at point 99 is not equal to this reference voltage established by this resistance network at point 89, then amplifier 111 will supply the proper polarity voltage to the input of the analog servo feedback amplifier 116 via field effect transistor 114, which is normally conducting, and will thereby force transistor 115 to drive more or less current, as may be called for, in transistor 117 so as to increase or decrease thereby the collector current flowing from transistor 117 to the cathode of the hollow cathode lamp 60 so as to increase or decrease thereby the output light intensity of the hollow cathode lamp. Consequently, the reference current $I_R$ generated by the reference photodiode 94 will generate a voltage at point 99 which will be equal to the reference voltage 89, thus balancing the circuitry. The reference current $I_R$ passing through the co-axial cable 95 shall remain constant for the time duration that the timing servo slot 76 is permitted to pass light therethrough in the filter position detector circuit 71, as decoded by the decoder circuit 79, which has been previously enabled by a signal on line 77. Also, current passing through the reference current resistor 110 from point 99 also remains constant. With a blank absorbing medium in the cuvette 34, therefore, the sample current $I_S$ generated by photodiode 96 will then be substantially equal to the current passing through the reference current resistor 110.

Under this balanced condition, the emitter currents of transistors 106 and 108, connected in a common-emitter configuration, will be approximately the same and the normalized output voltage $V_{out}$ at the logarithmic amplifier output 91 will be:

$$V_{out} = \left(\log_{10} \frac{I_R}{I_S}\right)(-3.5\ V) = K_1 \log_{10} \frac{I_R}{I_S} \quad 20$$

where $K_1$ represents the gain factor of the logarithmic amplifier, and it is −3.5 volts per decade.

When an absorbing medium, such as hemolyzed whole blood, is introduced into the cuvette 34, the output of the logarithmic amplifier at 91 will change −3.5 volts per decade of current change at the sample photodiode 96. The preferred dynamic range for the logarithmic amplifier 90 is for the sample current $I_S$ from 25 nanoamperes to 150 picoamperes and for the reference current $I_R$ from 2.5 nA to 1.5 nA.

The sample current $I_S$ is connected via co-axial cable 97 to amplifier 100. A low current adjustment for the logarithmic amplifier 90 is formed by the resistors 102 and 102a. Connected to the base of transistor 108 are a variable resistor 105, designed to set the voltage per decade adjustment, a zero adjust potentiometer 107, and a resistor 104. The base of the other transistor 106 is grounded, as shown. The gain is set using resistor 105 to +0.7 V per decade at the output of amplifier 100. The output of amplifier 100 is connected to the input of amplifier 103 whose output at 91 represents the negative output of the logarithmic amplifier, which is −3.5 V/D.

The high current adjustment network for the logarithmic amplifier 90 consists of variable resistor 112 and resistor 112a and it will allow for a voltage offset adjustment as may be required by transresistance amplifier 88, buffer amplifier 98 and amplifier 101 and it also will take care of dark currents and leakage currents of the photodiode 94 and the input bias current of transresistance amplifier 88.

When the particular timing servo slot 76 has passed by the light generated by the LED in the filter position detector circuit 71 and as decoded by decoder circuit 79, the reference current $I_R$ generated by the reference photodiode 94 will again be decreased since the transistor 113 and diodes D3 and D4 will be once again turned on due to the disappearance of the negative signal on servo pulse line 73 going to the base of NPN transistor 113 and, as a consequence, amplifier 111 and field effect transistor 114 will be again shut off. In this condition, the current driving the hollow cathode lamp 60 will be reduced to the idle current as set by the resistor network composed of idle adjust resistors 118a, 118b, and 118c. This is significant in that it greatly increases the useful life of the hollow cathode lamp 60 in the operation of the instrument.

The maximum current that is available in the servo mode and that can be supplied to the hollow cathode lamp 60 is determined by the resistor 121, which will cause transistor 119 to short to ground any time this limit is exceeded, disabling thus the hollow cathode lamp. Transistor 119 is connected between the output of servo feedback amplifier 116 and the emitter of transistor 117 through resistor 123.

Figure 6:
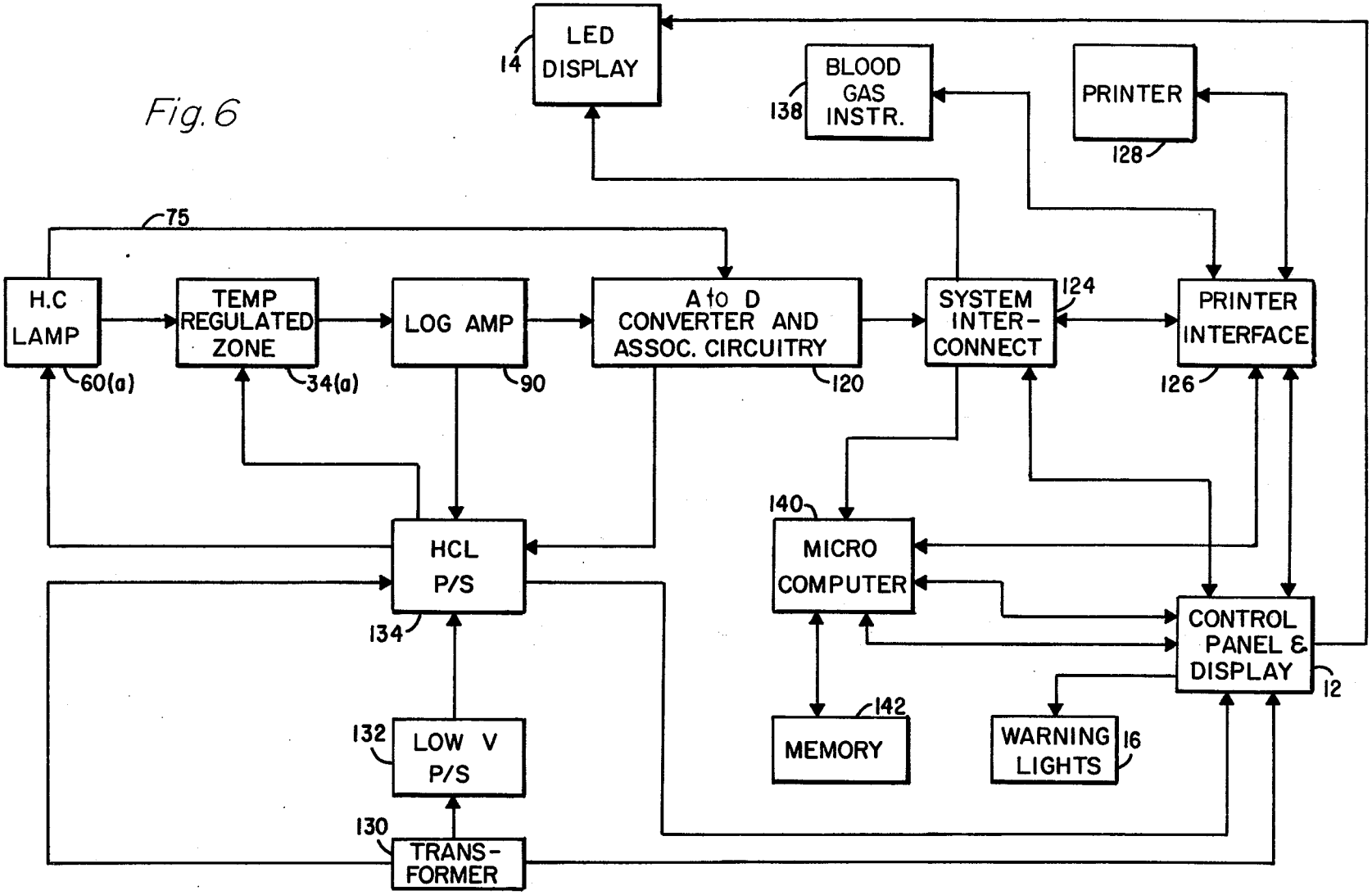
FIG. 6 shows the overall electrical system of the apparatus of the invention in a block diagram form.

The instrument is designed to be connected to any conventionally found AC power supply such as 100, 115, 230 VAC 60 Hz or 100, 115, 230 VAC 50 Hz, by means of a versatile constant voltage transformer 130. The overall electrical system of the apparatus of the invention is shown in block diagram form in FIG. 6 and as may be noted therein, the transformer 130 in turn powers a low voltage power supply 132, the hollow cathode lamp power supply 134 and the control panel and display 12.

The function of the low voltage power supply 132 is to supply the apparatus with five precisely regulated DC voltages, namely, +15 V DC, −15 V DC, +5 V DC at one ampere and +5 V DC at 3 amperes and −10 V DC. The power supply 134 for the hollow cathode lamp and associated circuitry 60*a* is to provide the proper power for controlling the intensity of the lamp when sampling, to provide the power to the temperature regulated zone 34*a*, to sense the signal from the logarithmic amplifier 90 in order to control the operation of the filter wheel 70, to provide power for the operation of the motor 40*a* and also of the hemolyzer solenoid 28.

The analog to digital converter and associated circuitry 120 receives analog information from the logarithmic amplifier 90 and the synchronization and sample pulses from the hollow cathode lamp and associated circuitry 60*a* via line 75 and essentially converts the logarithmic amplifier information into a binary output so that it can be both stored digitally as well as worked upon by a suitable micro-computer 140 provided with a memory 142 which may either be composed of PROMs or ROMs. To arrange for the proper channeling and interconnection of the various components, a system interconnect 124 is provided connecting the analog to digital converter and associated circuitry 120 to the micro-computer 140 and furthermore is having connections to the control panel and display 12, or light emitting diode display 14 and also the previously described set of warning lights 16.

The apparatus of the invention is also provided with a printer interface 126 whose function is to enable a printer accessory 128 to be operationally connected with the apparatus 10 of the invention and also with a blood gas instrument 138, such as for example one designed to measure parameters of whole blood such as the pH, $PCO_2$ and $PO_2$ thereof. The design of the printer interface is such that either instrument may be operated independently with the printer or that both instruments may be operated with it, allowing thereby the printing of data from both instruments on the same patient printer ticket.

The analog to digital converter and associated circuitry 120 includes in known fashion a gain scaling amplifier, a fourchannel multiplexer and decoder circuit, a sample and hole amplifier, a reference voltage amplifier and a filter wheel signal decoder, in addition to the basic analog to digital converter.

The micro-computer 140 likewise comprises known parts which include a central processor unit, a system clock, a RAM memory, and convenient interface units, ports and control circuits. The memory 142 includes a PROM or ROM memory array, a memory address buffer, a chip select decoder, a data output buffer and suitable enable control circuits, as is well known to persons skilled in the art to provide in combination a read only memory storage designed for static operation.

Figure 8:
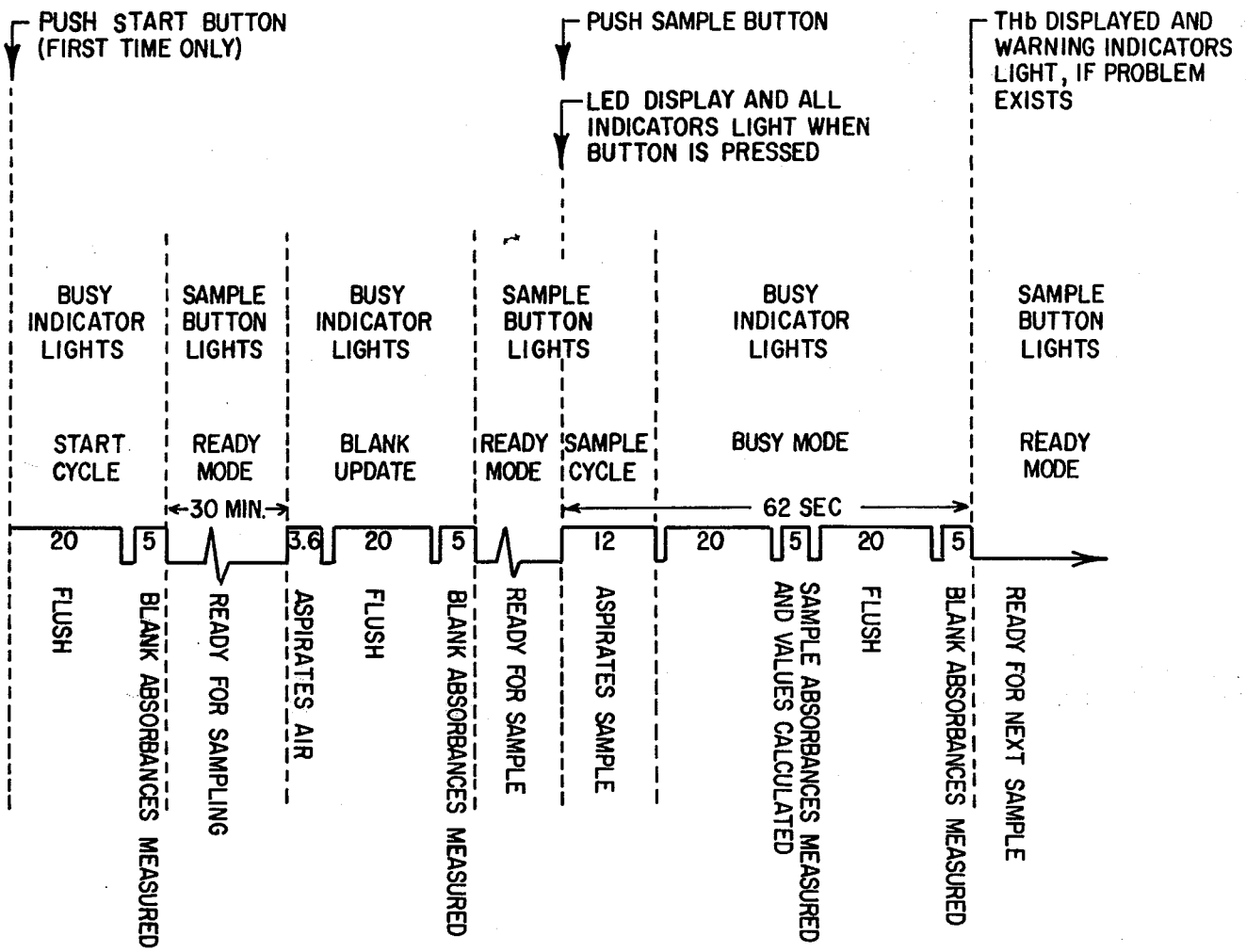
FIG. 8 depicts the flow chart of system operation in the preferred embodiment of the apparatus of the invention.

The operation of the apparatus 10 of the invention may best be described with reference to FIG. 8 showing the flow-chart of system operation, in conjunction with FIG. 1, already described. After the apparatus has been plugged into a conventional AC power supply by means of a suitable connecting cord (not shown) and a power switch located on the rear panel (not shown) has been turned on, the instrument is first preferably allowed to be warmed up for a period of time. The operator will, of course, note right away that the power is on in the instrument since this state will be indicated by the light 38, which is always on when the power is on.

As already mentioned, the only user-adjustable calibration is by means of a screwdriver adjusted potentiometer 22 located on the front panel 12 so as to permit the operator to calibrate the total hemoglobin displayed at 14 on the instrument panel. Such calibration is required when the apparatus is first installed, any time the pump windings have been changed or whenever the cuvette 34 has been changed or disassembled. Of course, the operator may wish to check this calibration routinely in the operation of the instrument, say about once a week. Calibration will be inhibited if any of the warning lights 16 appear on the display panel 12 with the exception of "not for humam blood" and "high MetHb question data." Prior to manipulating the calibration potentiometer 22, the operator positions the toggle switch 20*a* into the upper calibrate position and by pushing the start button 18*a*, a blank update cycle will be initiated and, following aspiration of the calibration standard and the flushing of the fluidic system, the total hemoglobin is displayed at 14.

If the value displayed is different from the calibration value of the standard, the operator will adjust potentiometer 22 with a screwdriver until the display value at 14 reads exactly the same as the calibration value of the standard. This calibration procedure is preferably repeated once to check the values again. After calibration the switch 20*a* is placed down to the "run" position.

The toggle switch 20*b* has three operative positions and it interfaces the apparatus with a printer and also, if desired, with another blood gas instrument, as previously mentioned. With toggle switch 20*b* in the center of its slot, the printer is designed to work with the apparatus of the invention only. If toggle switch 20*b* is positioned uppermost in its slot, the printer is operationally connected only with the other blood gas instrument 138. With the toggle switch 20*b* in its lowermost position, the printer will be operatively connected to both the apparatus of the invention 10 as well as to another blood gas instrument 138. Of course, the printer is an optional equipment and the apparatus of the invention will function without it.

Toggle switches 20*c* and 20*d* affect the operation of the fluid-flow system; with toggle switch 20*c* positioned in the upper position, a longer sample aspiration time takes place than when it is positioned in its lower "short" position. Toggle switch 20*d* affects the operation of the electric motor 40*a* so that when it is moved upward it will start to rotate the pump-cage 44 on the aspirate side and with the toggle switch 20*d* pushed down, the pump-cage on the flush side 46 will be rotated, each in the respective direction of the arrows shown in FIG. 2. Operation of the instrument may be inhibited any time by the operator conveniently pushing the stop button 24.

With the instrument properly warmed up and calibrated, the operator will first push the start button 18*a* which will initiate a blank update cycle lasting 25 seconds at 60 Hz during which time this button 18*a* remains lit. As may be noted in FIG. 8, the first 20 seconds of this cycle involves the flushing of the fluidic system of the instrument by operating the pump-cage 46 on the right hand side of the pump 40. During this time a zeroing flush solution, which may preferably contain octylphenoxydecaethanol with a mold inhibitor, is drawn through the flush tube winding 45 from the bottle 58 and hence through the "T" adapter 33, coiled tubing 31, flush solution preheater portion 27, cuvette 34, blood preheater portion 25, around the hemolyzer tubing 55, and into the second "T" 48 and from there, through tubing 51 and sampler probe 52 into the waste bottle 54. If for any reason the sampler probe 52 is not in its lowered position, as shown in FIG. 2, the flush cycle cannot take place and an alarm will sound at set intervals and sample button **18*b* will flash until such time that the sampler probe is lowered into the waste bottle 54. With zeroing flush solution in the cuvette 34, the instrument will now measure blank absorbances during the next five seconds and then the light in the start button 18*a* will go out, while at the same time the red sample button 18*b* will be lit, indicating that the instrument is now ready for sampling. It should be noted that the true absorbance of a blood sample at a given wavelength is the measured absorbance of the blood sample less the measured absorbance of the blank of the cuvette 34**. This latter value is thus periodically updated in the instrument, further enhancing thereby the accuracy and reliability of instrument readings.

The sample button **18*b* will now remain lit for the next approximately 30 minutes to indicate that the apparatus is in the ready mode and can be presented samples of whole or hemolyzed blood during this time. After the expiration of this 30 minutes, the apparatus will automatically commence a blank update cycle (button 18*b* will go out) by first aspirating air through the sampler probe 52 for a period of 3.6 seconds (button 18*a* will now light indicating "busy"), followed by a flushing cycle of 20 seconds' duration at 60 Hz, followed by measurement of blank absorbances through the cuvette for the next 5 seconds, all as previously mentioned. Thereafter, the busy light 18*a* will go out and the red sample button 18*b*** will be lit, once again to indicate that the instrument is ready for sampling.

For sampling, the operator will move the standard sampler 50 with its attached sampler probe 52 into the raised position, shown in FIG. 1, and then introduce the probe 52 into a suitable container containing whole or hemolyzed blood of a particular patient. With the sampler probe 52 sufficiently immersed in the sample of whole blood and while so maintained therein, the operator depresses the sample button **18*b*. It should be noted that while the sample button 18*b* is so depressed, all warning lights 16*a* through 16*f* as well as the LED display 14 light up. This allows the operator to note that everything is properly functioning, especially since thay all should go out once the pressure is released on the button 18*b*, excepting the light in the button 18*b*. This will start the sample cycle of 12 seconds at 60 Hz during which the aspirating pump-cages 44 will be rotated in the direction of the arrow, shown in FIG. 2, so as to aspirate both a given quantity of the sample through the probe 52 and tube 51 into the sample and diluent mixing "T" 48 as well as to aspirate the required precise amount of diluent from the diluent bottle 56 through diluent tube winding 41 and tube 53 to the same mixing "T" 48. In this "T" connection 48, an initial mixing of sample with diluent takes place. This mixing is further enhanced as the mixture is carried by the flexible tubing 55 around the solenoid hemolyzer 28 and from there the now mixed and hemolyzed blood is admitted into and through the cuvette 34 until the hemolyzed blood at least partially fills the transparent coiled tubing 31. The preferred diluent is octylphenoxydecaethanol with suitable buffers and a mold inhibitor. Care must be taken that no aspirated blood reaches the other "T" adapter 33, however. The fluid-flow system is so arranged that normally during this 12 second at 60 Hz aspirating cycle about half of the tubes in the coiled tubing 31** will be filled with hemolyzed blood.

Immediately following this 12 second at 60 Hz aspiration cycle, the sample button light **18*b* will go out and the busy indicator light 18*a* will go on, and pump 40 will stop. This will signal to the operator to withdraw the sampler probe 52 from the container of sample of human blood, wipe the sampler probe 52 and to move the sampler into its lowered position in the waste bottle 54, as shown in FIG. 2. During the next 20 seconds at 60 Hz, the instrument will adjust, as needed, the thermal equilibration of the cuvette 34 and its sample of hemolyzed blood contained therein to approximately 37.0° C. This is done by means of a convenient electrical heater mounted on the walls of the temperature regulated zone 34*a***, with the heaters not shown in the drawings.

Following the 20 second equilibration time, the instrument automatically measures the absorbances of the sample and calculates the values, with all of this taking place during the next 5 seconds. This 5 second interval is initiated when the filter wheel synchronizing notch 74 trips the filter position detector circuit 71 and commences the fivefold rotation of the filter wheel 70, with each rotation thereof lasting for one second and representing one cycle. Each one-second cycle of the filter wheel's rotation consists first of 125 milliseconds, the time it takes for the leading edge of the servo slot 76 to reach its position within the detector circuit 71, initiating a servo pulse. The servo pulse will last 50 milliseconds at 60 Hz which represents a window for the respective narrow band-width filter 72 so as to permit a 30 millisecond at 60 Hz sample pulse generated by the hollow cathode lamp 60 to be passed therethrough as set by the somewhat shorter sample slot 78. It takes about 200 milliseconds before the next succeeding servo pulse is triggered for the next succeeding narrow band-width filter 72. Thus, there are for servo pulses and four sample pulses, one for each narrow band-width filter 72 during each one-second cycle rotation of the filter wheel 70.

Five such one-second cycles are used in input sample data into the apparatus of the invention. On the first cycle, the highest output voltage at point 91 is measured which occurs at the fourth servo pulse passing the detector circuit 71, and this voltage is used to determine the gain selection for an amplifier in the A to D Converter and associated circuitry 120, previously described with reference to FIG. 6. Sample data acquisition for the apparatus of the invention is then made on the second, third, fourth and the fifth revolutions of the filter wheel 70.

From these measured absorbances, calculations are then made by the micro-computer 140 together with its memory 142, as previously described. This memory 142 will have been previously programmed, among others, with the sixteen inverse extinction coefficients for reduced hemoglobin, oxyhemoglobin, carboxyhemoglobin and methemoglobin, each at the four selected wavelengths, as previously mentioned with respect to FIG. 5. It should be noted at this point that the instrument is capable of performing such determinations with other than human blood provided, of course, that the proper extinction coefficients for the particular animal blood have been previously determined and the values thereof introduced into the memory bank 142 of the system. When sampling or working with animal blood, the warning light 16a "not for human blood" remains constantly lit on the display panel 12 of the instrument. This light is activated, and the appropriate set of animal coefficients are selected by a binary switch located on the rear panel of the instrument (not shown) forming part of the memory 146.

After these five second at 60 Hz sample absorbance measurements and internal calculations, as above described, the apparatus will be automatically flushed for the next 20 seconds at 60 Hz followed by a five second at 60 Hz interval during which blank absorbances are measured. This past 62 second cycle thus represents the total time that the instrument requires to complete one sampling and is immediately followed by the extinguishment of the busy light 18a, the lighting of the sample button 18b and, of course, the simultaneous and automatic display in digital form of the total hemoglobin calculated by the instrument on the basis of the measured absorbance values and now prominently displayed at the LED display 14. If at the same time no warning lights 16b through 16f are displayed, then the operator may note and record this displayed value for total hemoglobin. Simultaneously with the digital display of the total hemoglobin value, its button 18c is lit. Thereafter, the operator may conveniently push any one of the remaining buttons: 18d for % oxyhemoglobin, 18e for % carboxyhemoglobin, 18f for % methemoglobin, and 18g for oxygen content.

Although the invention has been described above in connection with a preferred embodiment thereof, it is clear that certain modifications are possible with respect to particular applications of the invention so that the preferred embodiment thereof shown in the drawings and described above is to be understood as being only by way of example.

What is claimed is:

1. An apparatus for analyzing and digitally displaying a plurality of parameters of blood comprising
- means for aspirating and simultaneously mixing a sample of blood with a diluent,
- means for hemolyzing said mixture,
- means for generating spectral lines, said means being servo-controlled so as to maintain the light intensity output of said spectral lines constant,
- means for measuring for more than two absorbances of said mixture at at least four wavelengths in the visible spectrum as defined by said means for generating said spectral lines, including means of maintaining said mixture at a constant temperature during said measurement,
- means for calculating said plurality of parameters based on said measured absorbances,
- means for automatically displaying in digital form one of said calculated parameters, and
- means for displaying one at a time the remaining calculated parameters responsive to operator intervention.

2. The apparatus of claim 1 in which said means for generating spectral lines is a hollow cathode lamp.

3. The apparatus of claim 2 in which said hollow cathode lamp comprises a cathode made of thallium (Tl) enveloped in neon (Ne) gas.

4. The apparatus of claim 1 in which said means for generating spectral lines is a laser.

5. The apparatus of claim 1 in which said means for generating spectral lines is a hollow cathode lamp having a cathode made of thallium (Tl) enveloped in neon (Ne) gas and servo-controlled so as to maintain its light intensity output constant.

6. An apparatus for analyzing and digitally displaying a plurality of parameters of whole blood comprising:
- means for aspirating and simultaneously mixing a sample of whole blood with a diluent,
- means for hemolyzing said mixture,
- source means for generating spectral lines of narrow bandwidth,
- means for maintaining the output of said spectral line source constant during measurement,
- a logarithmic amplifier having input and output,
- means for making the logarithmic amplifier output insensitive to variations in the intensity of said source means for generating said spectral lines,
- means for measuring for more than two absorbances of said mixture at at least four wavelengths in the visible spectrum as defined by said means for generating said spectral lines, including means of maintaining said mixture at a constant temperature during said measurement,
- means for calculating said plurality of parameters based on said measured absorbances,
- means for automatically displaying in digital form one of said calculated parameters, and
- means for displaying one at a time the remaining calculated parameters responsive to operator intervention.

7. The apparatus of claim 6 further including a means of flushing said mixture after each measurement.

8. The apparatus of claim 7 further including a means of calibrating one of said calculated parameters of said apparatus with a known standard.

9. An automatic blood analysis apparatus comprising
- a fluid-flow system including means for aspirating and simultaneously mixing a sample of whole blood with a diluent and conducting the mixture through a hemolyzer and into a cuvette maintained at a constant temperature,
- a hollow cathode lamp for generating a plurality of selected wavelengths which will not drift and passing said spectral lines at said selected wavelengths through said cuvette containing said mixture,
- sensing means measuring for more than two absorbances of said mixture at at least four wavelengths and at each said selected wavelength and for generating signals responsive thereto,
- computer means for receiving signals from said sensing means and for calculating a plurality of parameters of said sample based on said absorbances,
- means for automatically displaying in digital form one of said calculated parameters,
- and means for displaying one at a time the remaining calculated parameters in response to operator intervention,
- in which said means for aspirating and simultaneously mixing a sample includes a multi-segment peristaltic pump having a plurality of pump-cages disposed about a drive shaft for selective rotation therewith and a plurality of flexible tubes wound about said pump-cages, with said pump-cages also acting as pinch-valves precisely to arrest fluid pumped through said tubes.

10. The apparatus of claim 9 in which said hollow cathode lamp comprises a cathode made of thallium (Tl) enveloped in neon (Ne) gas.

11. A method of analyzing and digitally displaying a plurality of parameters of a common sample of whole blood comprising aspirating and simultaneously mixing a sample of whole blood with a diluent, hemolyzing said mixture, bringing said hemolyzed mixture to a constant temperature within a cuvette, measuring for at least four absorbances of said hemolyzed mixture each at more than two wavelengths in the visible spectrum while maintaining the mixture at said constant temperature, calculating said plurality of parameters on the basis of said plurality of measured absorbances at each said plurality of wavelengths, automatically displaying in digital form one of said calculated parameters, displaying seriatim the operator-selected remaining calculated parameters, calibrating periodically for a single parameter only of said plurality of parameters, and introducing a flush solution for removing the aspirated sample.

12. The method of claim 11 in which the range of absorbances at one wavelength is measured and calculated to monitor the efficiency of completion of hemolysis of said mixture.

13. The method of claim 11 in which the range of absorbances at one wavelength is measured and calculated to monitor for the absence of bubbles within said cuvette.

14. A method for the automatic and simultaneous analysis of a common sample of whole blood for a plurality of parameters thereof comprising aspirating and mixing a sample of whole blood with a diluent, hemolyzing and bringing to a constant temperature said mixture, measuring for at least four absorbances of said mixture, each with said absorbance measured at four selected wavelengths, automatically calculating for said plurality of desired parameters on the basis of said plurality of measured absorbances and pre-programmed values, automatically converting said calculations into digital form and then displaying one of said converted calculations, displaying thereafter and one at a time the remaining converted calculated parameters in response to operator intervention, calibrating periodically for a single parameter only of said plurality of parameters, introducing a flush solution for removing the aspirated sample, and monitoring the efficiency of removal of the aspirated mixture from the cuvette.

15. The method of claim 14 in which the range of absorbances at one wavelength is measured and calculated to monitor the efficiency of completion of hemolysis of said mixture.

16. The method of claim 14 in which the range of absorbances at one wavelength is measured and calculated to monitor for the absence of bubbles within said mixture.

17. An apparatus for analyzing and digitally displaying a plurality of parameters of blood comprising means for aspirating and simultaneously mixing a sample of blood with a diluent, means for hemolyzing said mixture, means for generating spectral lines, means for measuring for more than two absorbances of said mixture at at least four wavelengths in the visible spectrum as defined by said means for generating said spectral lines, including means of maintaining said mixture at a constant temperature during said measurement, means for calculating said plurality of parameters based on said measured absorbances, means for automatically displaying in digital form one of said calculated parameters, and means for displaying one at a time the remaining calculated parameters responsive to operator intervention, in which said means for aspirating and simultaneously mixing a sample of blood with a diluent includes a multi-segment peristaltic pump having a plurality of pump-cages disposed about a drive shaft for selective rotation therewith and a plurality of flexible tubes wound about said pump-cages, said pump-cages acting as pinch-valves precisely to arrest fluid pumped through said tubes.

18. An automatic blood analysis apparatus comprising a fluid-flow system including means for introducing and simultaneously mixing a sample and conducting the mixture through a hemolyzer and into a cuvette maintained at a constant temperature, a source of spectral lines for generating a plurality of selected wavelengths which will not drift and passing said spectral lines at said selected wavelengths through said cuvette containing said mixture, sensing means for measuring the absorbances of said mixture and for generating signals responsive thereto, micro-computer means for calculating a plurality of desired parameters of said sample responsive to said signals generated in response to said absorbance measurements, and means receiving said calculations and converting them for display in digital form one at a time, in which said fluid-flow system including means for introducing and simultaneously mixing a sample comprises a multi-segment peristaltic pump having a plurality of pump-cages disposed about a drive shaft for selective rotation therewith and in which said source of spectral lines is a hollow cathode lamp having a cathode made of thallium (Tl) enveloped in neon (Ne) gas and servo-controlled so as to maintain its light intensity output constant.

* * * * *